US011124403B2

(12) United States Patent
Fujikake et al.

(10) Patent No.: US 11,124,403 B2
(45) Date of Patent: Sep. 21, 2021

(54) GUIDE MEMBER

(71) Applicant: SUNTORY HOLDINGS LIMITED, Osaka (JP)

(72) Inventors: Jun Fujikake, Tokyo (JP); Kristofer Kelley, Frankfort, KY (US)

(73) Assignee: SUNTORY HOLDINGS LIMITED, Osaka (JP)

( * ) Notice: Subject to any disclaimer, the term of this patent is extended or adjusted under 35 U.S.C. 154(b) by 0 days.

(21) Appl. No.: 16/269,284

(22) Filed: Feb. 6, 2019

(65) Prior Publication Data

US 2020/0247568 A1 Aug. 6, 2020

(51) Int. Cl.

| | |
|---|---|
| ***B67C 3/26*** | (2006.01) |
| ***B65B 39/00*** | (2006.01) |
| ***B65B 3/04*** | (2006.01) |
| ***B65B 3/36*** | (2006.01) |
| ***B65B 37/02*** | (2006.01) |
| ***B65B 35/26*** | (2006.01) |

(52) U.S. Cl.

CPC ..... *B67C 3/2637* (2013.01); *B65B 3/04* (2013.01); *B65B 3/36* (2013.01); *B65B 35/26* (2013.01); *B65B 37/02* (2013.01); *B65B 39/004* (2013.01); *B67C 2003/266* (2013.01)

(58) Field of Classification Search

CPC ..... B65B 39/004; B65B 3/04; B65B 3/18; B65B 3/36; B65B 35/26; B65B 37/02; B67C 2003/266; B67C 2003/2662; B67C 2003/2657; B67C 2003/2651; B67C 3/2637; B67C 2003/2654

See application file for complete search history.

(56) References Cited

U.S. PATENT DOCUMENTS 2,663,479 A * 12/1953 Detrez ..... B67C 3/16 141/47
3,695,315 A * 10/1972 Ayars, Jr. ..... B67C 3/2637 141/368
3,807,463 A * 4/1974 Rademacher ..... B67C 3/06 141/62
4,151,867 A * 5/1979 Wilhere ..... B67C 3/2637 141/291
4,938,261 A * 7/1990 Petri ..... B67C 3/06 141/147
5,150,740 A * 9/1992 Yun ..... B67C 3/2628 141/40

(Continued)

*Primary Examiner* — Andrew D St.Clair
(74) *Attorney, Agent, or Firm* — Greenblum & Bernstein, P.L.C.

(57) ABSTRACT

A guide member including: an upper main body that is positioned so as to enclose the filling valve and so as to be movable in a vertical direction relative to the filling port; and a lower main body that is positioned so as to enclose the upper main body and is configured to be slidable on the surface of the upper main body. The lower main body is provided with an abutting portion that protrudes inward relative to the inner surface of the lower main body and that is configured to abut against at least an opening portion of the container mounted on the container supporting unit, and the guide member is configured to allow the container to be lifted while keeping the abutting portion abutted against the opening portion, thereby guiding the opening portion to an appropriate position relative to the filling port.

3 Claims, 7 Drawing Sheets

(56) References Cited

U.S. PATENT DOCUMENTS

| | | | | |
|---|---|---|---|---|
| 5,156,200 | A * | 10/1992 | Mette | B67C 3/26 141/287 |
| 2011/0030843 | A1 * | 2/2011 | Krulitsch | B67C 3/2614 141/311 R |

* cited by examiner

GUIDE MEMBER

BACKGROUND OF THE INVENTION

1. Field of the Invention

The present invention relates to a guide member that is attachable to a filling valve of a filler device that includes: the filling valve for filling a container with a product; and a container supporting unit configured to be lifted and lowered relative to the filling valve, the filling valve being provided with a filling port configured to be opened upon the container mounted on the container supporting unit being lifted as a result of the container supporting unit being lifted, and to be closed upon the container mounted on the container supporting unit being lowered as a result of the container supporting unit being lowered.

2. Description of the Related Art

A factory for manufacturing a product such as beverages is provided with a filler device that injects a beverage into a container such as a bottle or a can. The filler device is provided with, for example: a filler bowl in which a beverage is stored before being filled into a container; a plurality of filling valves that are provided in the filler bowl; container supporting units that are respectively provided below the filling valves and move along a circumferential trajectory in synchronization with the rotation of the filler bowl; a carry-in conveyer that conveys containers to the container supporting units; and a carry-out conveyer that conveys containers from the container supporting units (see FIGS. 1 and 2).

Containers that have been conveyed from the carry-in conveyer to the container supporting units are filled with a predetermined amount of beverage using the filling valves until the containers are conveyed from the container supporting units to the carry-out conveyor.

Each filling valve includes, for example: a housing that is tubular and penetrates through the bottom surface of the filler bowl; an outer valve body that is tubular and is inserted into the housing; an inner valve body that is tubular, the upper end thereof being fixed to the housing, and is inserted into the outer valve body; and a biasing unit that biases the outer valve body downward relative to the housing.

The container supporting units are configured to be lifted and lowered relative to the filling valves. Upon the opening portion of a container mounted on a container supporting unit pressing a press-target portion provided on the outer valve body of a filling valve upward as a result of the container supporting unit being lifted, the outer valve body is moved upward resisting a biasing force applied by the biasing portion, and accordingly a filling port that is provided at the lower end of the inner valve body is opened, i.e., the filling valve is opened. The product stored in the filler bowl passes through the respective internal spaces of the outer valve body and the inner valve body, and is filled into a container via the filling port.

The filling valve is configured such that: the filling of the container with the product is stopped upon the internal pressure of the container becoming equal to the internal pressure of the filler bowl; the outer valve body is moved downward as a result of the container supporting unit being lowered; and accordingly the filling port is closed by the lower end of the outer valve body, i.e., the filling valve is closed.

As described above, each filling valve is configured to be opened and closed as a result of a container being lifted and lowered. Therefore, if a container is not mounted at an appropriate position on a container supporting unit, there is the risk of the outer valve body not being properly lifted by the container, the filling port not being opened wide enough, and the flow rate of the beverage not reaching a predetermined rate. For example, if the flow rate of the beverage is lower than a predetermined rate, the time required to fill a container with a predetermined amount of beverage increases. Therefore, there is demand for a mechanism that can guide the opening portions of containers to appropriate positions relative to the filling ports.

Note that no appropriate prior art document that discloses the above-described filler device, which is prior art of the present invention, has been found, and therefore no prior art document such as a patent document is indicated herein.

SUMMARY OF THE INVENTION

The present invention has been made in view of the above-described situation, and an objective thereof is to provide a guide member that is attachable to a filling valve, and is capable of appropriately adjusting the respective positions of a container mounted on a container supporting unit and a filling port.

Characteristic configurations of a guide member according to the present invention for achieving the above-described objective lie in that the guide member is a guide member that is attachable to a filling valve of a filler device that includes: the filling valve for filling a container with a product; and a container supporting unit configured to be lifted and lowered relative to the filling valve, the filling valve being provided with a filling port configured to be opened upon the container mounted on the container supporting unit being lifted as a result of the container supporting unit being lifted, and to be closed upon the container mounted on the container supporting unit being lowered as a result of the container supporting unit being lowered, the guide member including: an upper main body that is positioned so as to enclose the filling valve and so as to be movable in a vertical direction relative to the filling port; and a lower main body that is positioned so as to enclose the upper main body and is configured to be slidable on the surface of the upper main body, wherein the lower main body is provided with an abutting portion that protrudes inward relative to the inner surface of the lower main body and that is configured to abut against at least an opening portion of the container mounted on the container supporting unit, and the guide member is configured to allow the container to be lifted while keeping the abutting portion abutted against the opening portion, thereby guiding the opening portion to an appropriate position relative to the filling port.

With the above-described configuration, the guide member guides the opening portion of the container to an appropriate position relative to the filling port of the filling valve. Thus, it is possible to appropriately open the filling port upon the container being moved upward. Upon the filling port being opened, the product supplied from the filler bowl to the respective internal spaces of the outer valve body and the inner valve body is appropriately filled into the container via the filling port. Note that the filling of the container with the product is stopped upon the internal pressure of the container becoming equal to the internal pressure of the filler bowl.

Also, the upper main body and the lower main body of the guide member are configured to be telescopic, and thus the guide member can expand and contract in a vertical direction. Therefore, before a container abuts against the guide member, the guide member is in an expanding state, and the opening portion of the container can be swiftly abutted against the abutting portion. Therefore, the guide member can thereafter smoothly guide the opening portion. Also, when the filling valve fills the container with the product, the guide member is in a contracted state. Therefore, although the guide member is positioned so as to enclose the filling valve, the guide member is not an obstruction in terms of space.

In the present invention, it is preferable that a lower outward protruding portion that protrudes outward is provided at a lower end of the upper main body, an inward protruding portion that protrudes inward is provided at an upper end of the lower main body, the upper main body and the lower main body are configured to be slidable on each other along a common axis such that at least the lower outward protruding portion slides on the inner surface of the lower main body, or the inward protruding portion slides on the outer surface of the upper main body, and the lower main body is configured such that the inward protruding portion and the lower outward protruding portion hook on each other due to the weight of the lower main body.

With the above-described configuration, the inward protruding portion and the lower outward protruding portion hook on each other due to the weight of the lower main body, and thus the lower main body is suspended from the upper main body.

In the present invention, it is preferable that the lower main body is provided with a push-up portion that is configured to come into contact with the lower outward protruding portion, and the push-up portion is configured to, when in contact with the lower outward protruding portion, push up the upper main body as a result of the lower main body moving upward due to the container being lifted.

With the above-described configuration, upon the lower main body being moved upward, the push-up portion comes into contact with the lower outward protruding portion and pushes up the upper main body. Therefore, it is unnecessary to provide a dedicated power source for moving the upper main body.

In the present invention, it is preferable that an upper outward protruding portion that protrudes outward is provided at an upper end of the upper main body, and the upper main body is configured such that the inward protruding portion and the upper outward protruding portion hook on each other when the lower main body is pushed up.

With the above-described configuration, when the lower main body and the upper main body need to be pushed up, the upper main body is pushed up when the lower main body is pushed up. Therefore, it is unnecessary to separately push up the lower main body and the upper main body.

In the present invention, it is preferable that the upper main body and the lower main body are tubular, and a side surface of the lower main body is provided with an opening portion.

With the above-described configuration, it is possible to look inside the lower main body through the opening portion. Therefore, when the abutting portion fails to abut against the opening portion, it is easy to find the failure.

In the present invention, it is preferable that the abutting portion is provided on an abutting member that is detachably attached to the lower main body.

With the above-described configuration, the abutting member can be replaced with another member that fits the shape of the container, for example. Also, when a failure occurs in the abutting member, it is possible to replace only the abutting member. Furthermore, it is possible to form the upper main body and the lower main body from a metal material, and form the abutting member from a resin material. Therefore, it is possible to mitigate the impact of the abutting portion of the abutting member when abutting against the opening portion.

In the present invention, it is preferable that the filling valve includes: a housing that is tubular and penetrates through the bottom surface of a filler bowl for storing the product; an outer valve body that is tubular and is inserted into the housing; an inner valve body that is tubular, the upper end thereof being fixed to the housing, and is inserted into the outer valve body; and a biasing unit that biases the outer valve body downward relative to the housing, the outer valve body is provided with a press-target portion that is configured to be pressed upward by the opening portion, the filling valve is configured such that the opening portion of the container mounted on the container supporting unit presses the press-target portion and moves the outer valve body upward as a result of the container supporting unit being lifted, and accordingly the filling port provided in a lower end of the inner valve body is opened, and the outer valve body is moved downward as a result of the container supporting unit being lowered, and accordingly the filling port is closed by a lower end of the outer valve body, the biasing unit includes compression coil springs provided between the housing and the press-target portion, the compression coil springs include an upper spring whose upper end is fixed to an upper fixing portion provided on the housing side; and a lower spring whose lower end is fixed to a lower fixing portion provided on the press-target portion side, the lower end of the upper spring and the upper end of the lower spring are coupled to each other by a coupling portion that is provided so as to be slidable on the surface of the outer valve body, the upper main body includes an upper case and a lower case that is detachably attached to the upper case, the upper case is located above the lower fixing portion, and is configured to be restricted from moving downward upon the lower end of the upper case coming into contact with the lower fixing portion, and the lower case is configured to extend downward relative to the lower fixing portion, and is configured to allow the press-target portion to slide on the inner surface of the lower case.

In the filling valve with the above-described configuration, the compression coil springs, which constitute a biasing unit, include an upper spring and a lower spring. Therefore, coil springs that are shorter than the stroke of the valve for opening the filling port can be employed as the upper spring and the lower spring.

The likelihood of a coil spring meandering is proportional to the length of the coil spring. If a coil spring meanders a lot when compressed, there is the risk of the coil spring coming into contact with the inner surface of the guide member and causing a failure when the filling port is to be opened. As in the above-described configuration, by using a plurality of coil springs that are short, considering the length of the stroke, and coupling them to each other in series using the coupling portion, it is possible to reduce the degree of meandering, compared to when using one long coil spring. Thus, it is possible to prevent a coil spring from coming into contact with the inner surface of the guide member. The guide member can be favorably attached to the filling valve with such a configuration. The guide member is configured as described above. Therefore, the guide member attached to the filling valve does not cause a failure when the filling port is to be opened. Note that the upper main body is provided such that the upper case is suspended from the lower fixing portion due to the weight of the upper main body.

In the present invention, it is preferable that the respective outer diameters of the upper fixing portion, the lower fixing portion, and the coupling portion of the filling valve are larger than the diameter of the upper spring and the lower spring, the inner diameter of the upper case is larger than the respective outer diameters of the upper fixing portion, the lower fixing portion, and the coupling portion, and the upper case is configured to be slidable at least on the coupling portion, the inner diameter of the lower case is larger than the outer diameter of the press-target portion, and the lower case is configured to be slidable at least on the press-target portion, and the length of the upper case is such that, when the lower end of the upper case covers at least a portion of the lower fixing portion, the upper end of the upper case covers the coupling portion, but does not cover the housing, whereas when the upper end of the upper case covers at least a portion of the housing, the lower end of the upper case covers the coupling portion, but does not cover the lower fixing portion.

With the above-described configuration, the upper case of the guide member is always slidable on the coupling portion, and can be lowered to a position where the upper case covers the lower fixing portion, or lifted to a position where the upper case covers the upper fixing portion, while being kept in such a state. During such movement, the lower case of the guide member slides on the press-target portion. The guide member slides while being guided by the coupling portion that slides on the outer valve body and the press-target portion that is provided on the outer valve body. Therefore, it is ensured that the guide member moves in a vertical direction along the axis of the outer valve body, i.e., the axis of the filling valve.

DETAILED DESCRIPTION OF PREFERRED EMBODIMENTS

Figure 1:
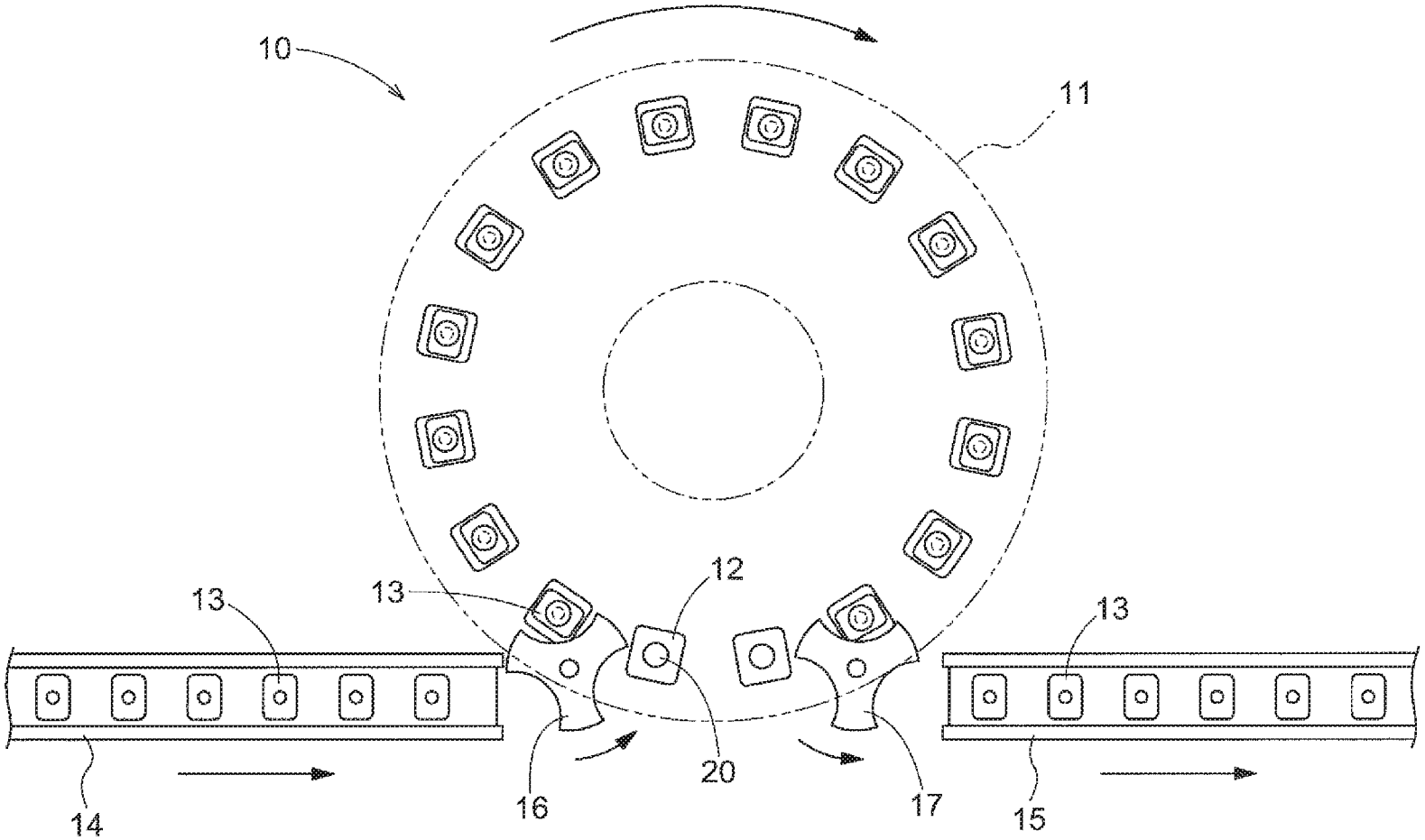
FIG. 1 is a plan view schematically showing a filler device.

The following describes a preferred embodiment of a guide member according to the present invention with reference to the drawings. Note that the following embodiment describes an example in which a filler device is provided in a factory for manufacturing whisky, which is a commercial product, and containers that are to be filled with whisky using filling valves are bottles. The term "whisky" in the present specification is not intended to limit its main ingredient to a specific ingredient among malt, corn, rye, etc., or exclude a specific ingredient from them, or limit its production region to a specific region among the United States, Canada, Japan, etc., or exclude a specific area from them. In the drawings, solid arrows indicate the flow of whisky, and dotted arrows indicate the flow of air.

Figure 2:
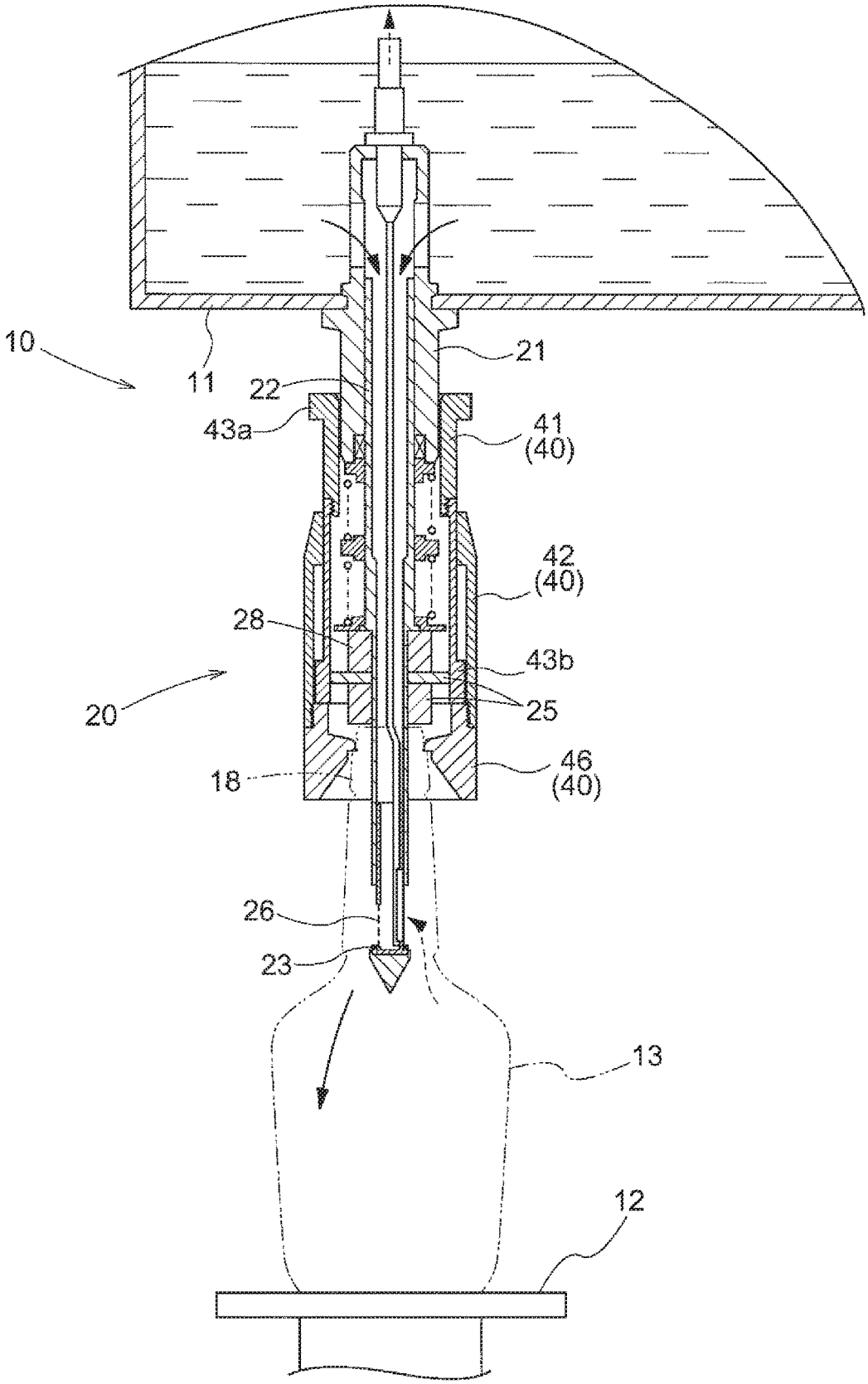
FIG. 2 is a cross-sectional view showing a main part of the filler device.

As shown in FIGS. 1 and 2, a filler device 10 includes, for example: a filler bowl 11 in which whisky is stored; a plurality of filling valves 20 provided in the filler bowl 11; container supporting units 12 that are respectively provided below the filling valves 20 and move along a circumferential trajectory in synchronization with the rotation of the filler bowl 11; a carry-in conveyer 14 that conveys bottles 13 to the container supporting units 12; and a carry-out conveyer 15 that conveys bottles 13 from the container supporting units 12.

The filler bowl 11 is a tank for storing whisky that is to be injected into the bottles 13. A plurality of (e.g., eighteen) filling valves 20 are arranged on the filler bowl 11 at equal intervals along a circumferential trajectory. The filler bowl 11 and the filling valves 20 are corrosion resistant to the product that is handled, i.e., whisky, and are also formed using a durable material such as stainless steel, which is a typical example.

The bottles 13, which have been conveyed from the carry-in conveyer 14 to the container supporting units 12, are filled with a predetermined amount of whisky using the filling valves 20 until the bottles 13 are conveyed from the container supporting units 12 by the carry-out conveyer 15. The bottles 13 that have been filled with whisky are conveyed from the container supporting units 12 to the carryout conveyer 15, and then a cap is put on each of the bottles 13.

The carry-in conveyer 14 and the carry-out conveyer 15 are formed using a conveyor mechanism that is a well-known mechanism such as a belt mechanism or a screw mechanism. A carry-in star wheel 16 and a carry-out star wheel 17 are provided to transfer the bottles 13 between the container supporting units 12 and the carry-in conveyer 14, and between the container supporting units 12 and the carry-out conveyer 15.

The container supporting units 12 are formed as mounts on which the bottles 13 can be respectively mounted. The container supporting units 12 are configured to be lifted and lowered by a cam mechanism (not shown) according to predetermined timing while moving along the rotation trajectory in synchronization with the rotation of the filler bowl 11.

Figure 4:
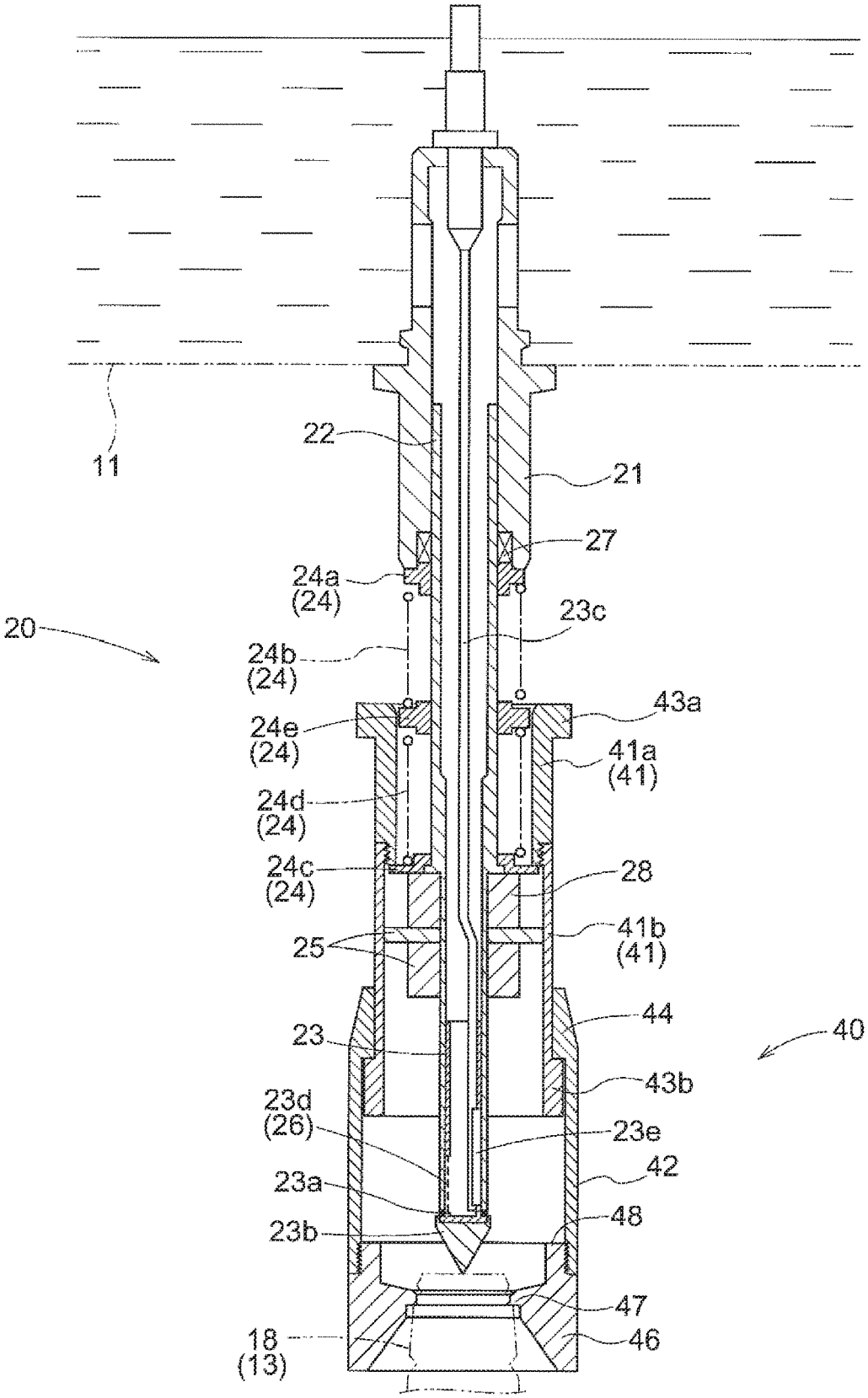
FIG. 4 illustrates details of a guide member according to the present invention.
Figure 5:
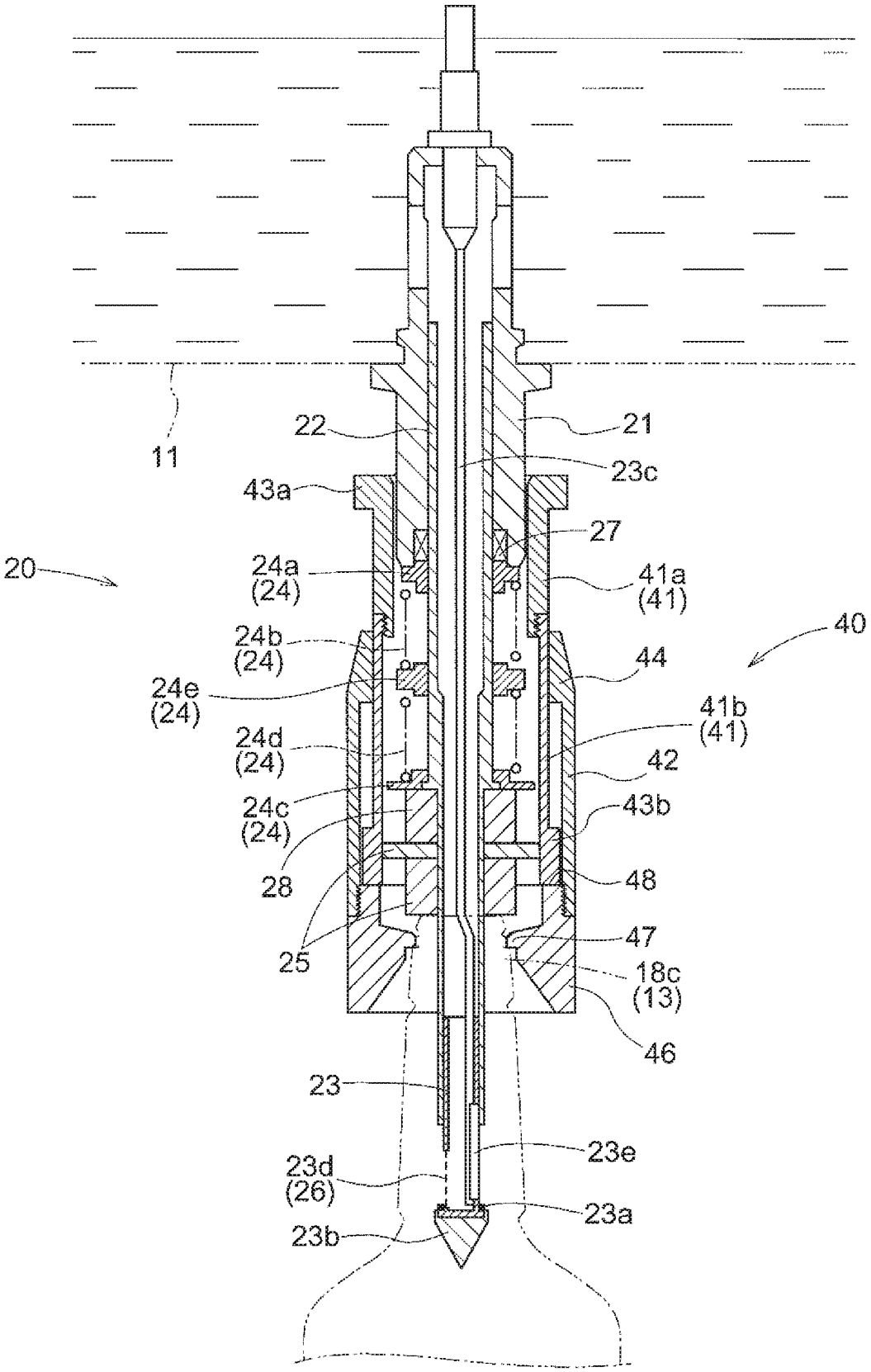
FIG. 5 illustrates details of the guide member according to the present invention.

The following describes the filling valves 20. As shown in FIG. 4 and FIG. 5 in detail, each filling valve 20 includes, for example: a housing 21 that is tubular and penetrates through the bottom surface of the filler bowl 11; an outer valve body 22 that is tubular and is inserted into the housing 21; an inner valve body 23 that is tubular, the upper end thereof being fixed to the housing 21, and is inserted into the outer valve body 22; and a biasing unit 24 that biases the outer valve body 22 downward relative to the housing 21.

The outer valve body 22 is provided with a press-target portion 25 that is configured to be pressed upward by an opening portion 18 of a bottle 13.

A seal 27 is provided on a surface of the housing 21 on which the outer valve body 22 slides. The seal 27 is formed using a well-known material such as rubber, resin, or elastomer.

The biasing unit 24 includes compression coil springs provided between the housing 21 and the press-target portion 25. The compression coil springs include: an upper spring **24*b* whose upper end is fixed to an upper fixing portion 24*a* provided on the housing 21 side; and a lower spring 24***d* whose lower end is fixed to a lower fixing portion 24*c* provided on the press-target portion 25 side. The compression coil springs are manufactured from a well-known material such as a steel wire, a piano wire, or a stainless steel wire, and are subjected to well-known end processing so as to form a closed end or an open end, for example.

The diameter of the upper spring 24*b* and the lower spring 24*d* is smaller than the inner diameter of a guide member 40 described below, and is larger than the outer diameter of the outer valve body 22, and is also set to an appropriate size so that the springs, when expanding and contracting, do not come into contact with the inner surface of the guide member 40 or the outer surface of the outer valve body 22. Furthermore, the length of the upper spring 24*b* and the lower spring 24*d* is set to an appropriate length so that the springs do not meander when expanding and contracting. Preferably, the upper spring 24*b* and the lower spring 24*d* are wound in directions different from each other.

The lower end of the upper spring 24*b* and the upper end of the lower spring 24*d* are coupled to each other by a coupling portion 24*e* that is provided so as to be slidable on the surface of the outer valve body 22.

In the present embodiment, the upper fixing portion 24*a*, the lower fixing portion 24*c*, and the coupling portion 24*e* are formed using a polyacetal resin, for example.

Both ends of the upper spring 24*b* and both ends of the lower spring 24*d* are each provided with a so-called end turn portion including one to several end turns that do not to contribute to expansion or contraction. The upper spring 24*b* and the lower spring 24*d* are located at predetermined positions such that the end turn portions thereof are fitted to the upper fixing portion 24*a*, the lower fixing portion 24*c*, and the coupling portion 24*e*, respectively.

With the above-described configuration, the press-target portion 25 is biased downward relative to the housing 21, due to an elastic force applied by the biasing unit 24.

Note that the respective outer diameters of the upper fixing portion 24*a*, the lower fixing portion 24*c*, and the coupling portion 24*e* of the filling valves 20 are larger than the diameter of the upper spring 24*b* and the lower spring 24*d*.

As shown in FIG. 5, as a result of the bottle 13 being lifted due to the container supporting unit 12 being lifted, the opening portion 18 of the bottle 13 mounted on the container supporting unit 12 presses the press-target portion 25 provided on the outer valve body 22 upward. Consequently, the outer valve body 22 is moved upward resisting the biasing force applied by the biasing unit 24, and accordingly a filling port 26 that is provided at the lower end of the inner valve body 23 is opened. Then, whisky in the filler bowl 11 passes through the respective internal spaces of the housing 21, the outer valve body 22, and the inner valve body 23, and is filled into the bottle 13 via the filling port 26.

Note that the inner valve body 23 includes: a valve body 23*b* that is provided with a seal 23*a* that seals the gap between the inner valve body 23 and the outer valve body 22 so as to be liquid-tight; and a pipe body 23*c* whose lower end is fixed to the valve body 23*b* and whose upper end is fixed to the housing 21. Note that the seal 23*a* is made of a well-known material such as rubber, resin, or elastomer.

An opening 23*d* is provided in the valve body 23*b*. This opening 23*d* constitutes the filling port 26. Note that the opening 23*d* is provided with a mesh member. The mesh member functions as a filter that prevents a foreign substance other than whisky, if present in the whisky in the filler bowl 11, from being filled into the bottle 13.

Also, an opening 23*e* that is opened upon the opening 23*d* being opened is provided in the lower end of the pipe body 23*c*. The opening 23*e* functions as an air vent for discharging the air in the bottle 13 to the outside when the bottle 13 is filled with whisky.

The filling valve 20 is configured such that: the filling of the bottle 13 with whisky is stopped upon the internal pressure of the bottle 13 becoming equal to the internal pressure of the filler bowl 11; the outer valve body 22 is moved downward as a result of the container supporting unit 12 being lowered; and accordingly the filling port 26 is closed by the lower end of the outer valve body 22.

The guide member 40 according to the present invention is configured to be detachably attached to such a filling valve 20.

Figure 6:
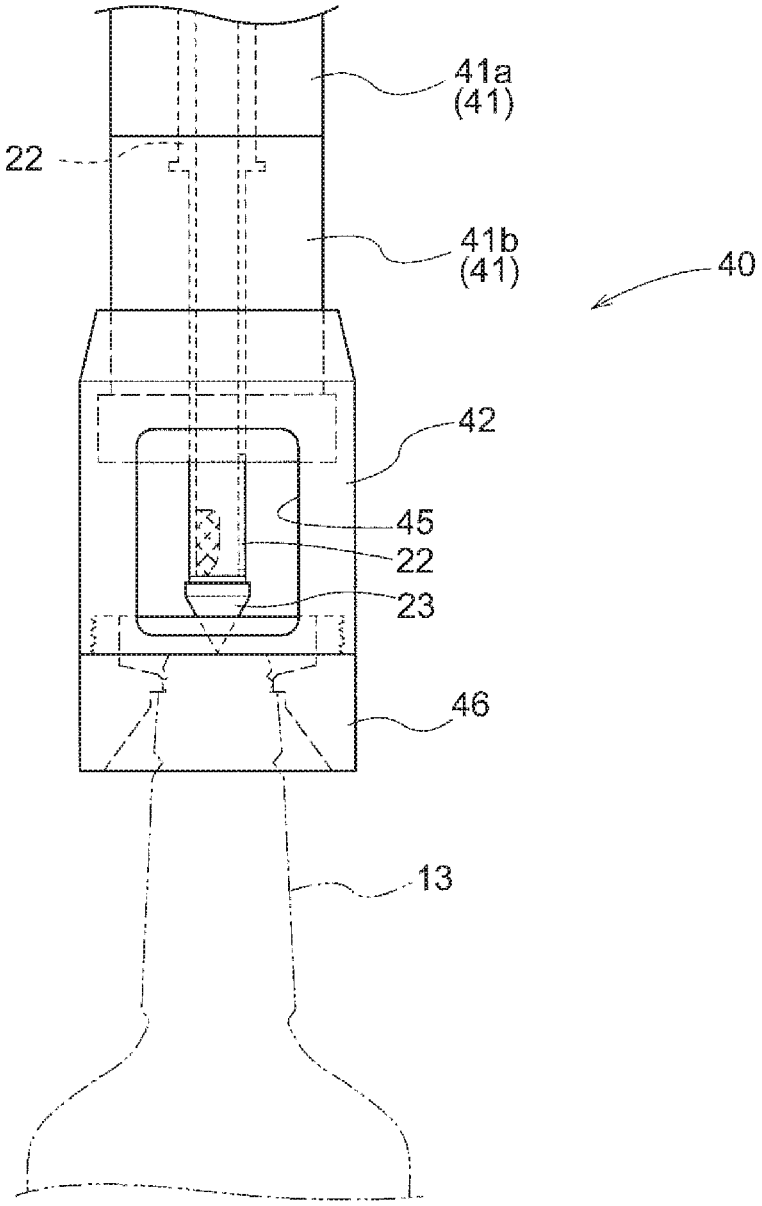
FIG. 6 illustrates an opening portion provided in the guide member.

As shown in FIGS. 4 to 6, the guide member 40 includes: an upper main body 41 that is positioned so as to enclose the outer valve body 22 and so as to be movable in a vertical direction relative to the outer valve body 22; and a lower main body 42 that is positioned so as to enclose the upper main body 41 and is configured to be slidable on the surface of the upper main body 41. The upper main body 41 and the lower main body 42 are tubular members, and are made of metal such as stainless steel in the present embodiment. An opening portion 45 is provided in a side surface of the lower main body 42 (see FIG. 6).

The upper main body 41 includes an upper case 41*a* and a lower case 41*b*. The upper case 41*a* and the lower case 41*b* are detachably coupled to each other by female screws and male screws engaging with each other. However, a configuration that enables the upper case 41*a* and the lower case 41*b* to be detachable is not limited in such a way. The upper case 41*a* and the lower case 41*b* may be configured such that, once they are coupled to each other, they cannot be disassembled.

An upper outward protruding portion 43*a* that protrudes outward is provided at the upper end of the upper main body 41, i.e., the upper end of the upper case 41*a*. Furthermore, a lower outward protruding portion 43*b* that protrudes outward is provided at the lower end of the upper main body 41, i.e., the lower end of the lower case 41*b*. An inward protruding portion 44 that protrudes inward is provided at the upper end of the lower main body 42.

The lower surface of the inward protruding portion 44 and the upper surface of the lower outward protruding portion 43*b* hook on each other due to the weight of the lower main body 42, and thus the lower main body 42 is suspended from the upper main body 41.

The upper main body 41 and the lower main body 42 are configured to be slidable on each other along a common axis such that the inward protruding portion 44 slides on the outer surface of the upper main body 41.

An abutting member 46 that includes an abutting portion 47 that protrudes inward relative to the inner surface of the lower main body 42 and that can abut against at least the opening portion 18 of the bottle 13 mounted on the container supporting unit 12 is detachably attached to the lower main body 42. The abutting member 46 is made of a polyacetal resin, for example. The abutting member 46 is configured to be detachably attachable to the lower main body 42 by being screwed into the lower main body 42. However, note that the abutting member 46 may be provided integrally with the lower main body 42.

Furthermore, the abutting member 46 is provided with a push-up portion 48 that is configured to come into contact with the lower outward protruding portion 43*b*. The push-up portion 48 is configured to push up the upper main body 41 as a result of the lower main body 42 moving upward due to the bottle 13 being lifted when the upper surface of the push-up portion 48 is in contact with the lower surface of the lower outward protruding portion 43*b*. Note that the push-up portion 48 may be provided integrally with the inner surface of the lower main body 42.

The upper case 41*a* of the upper main body 41 is located above the lower fixing portion 24*c*, and is configured to be restricted from moving downward upon the lower end of the upper case 41*a* coming into contact with the lower fixing portion 24*c*.

The inner diameter of the upper case 41*a* is larger than the respective outer diameters of the upper fixing portion 24*a*, the lower fixing portion 24*c*, and the coupling portion 24*e*, and the upper case 41*a* is configured to be slidable at least on the coupling portion 24*e*.

The lower case 41*b* is configured to extend downward relative to the lower fixing portion 24*c*, and is configured to allow the press-target portion 25 to slide on the inner surface of the lower case 41*b*.

The inner diameter of the lower case 41*b* is larger than the outer diameter of the press-target portion 25, and the lower case 41*b* is configured to be slidable at least on the press-target portion 25.

The length of the upper case 41*a* is such that, when the lower end of the upper case 41*a* covers at least a portion of the lower fixing portion 24*c* as shown in FIG. 4, the upper end of the upper case 41*a* can cover the coupling portion 24*e*, but cannot cover the housing 21, whereas when the upper end of the upper case 41*a* covers at least a portion of the housing 21 as shown in FIG. 5, the lower end of the upper case 41*a* can cover the coupling portion 24*e*, but cannot cover the lower fixing portion 24*c*.

The guide member 40 with the above-described configuration allows the bottle 13 to be lifted while keeping the abutting portion 47 of the abutting member 46 abutted against the opening portion 18, thereby guiding the opening portion 18 to an appropriate position relative to the filling port 26. The following describes such a situation with reference to FIG. 3.

Figure 3:
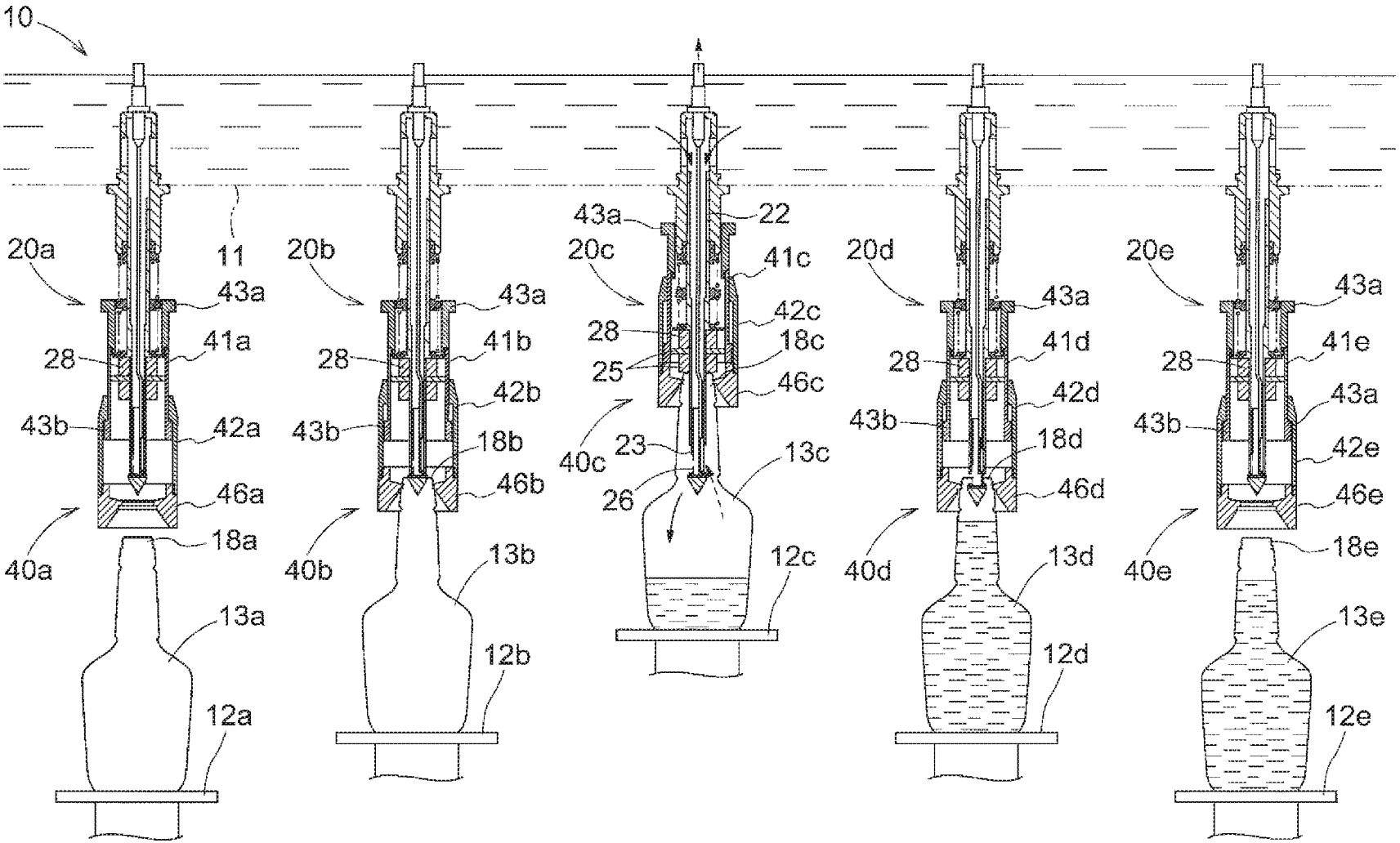
FIG. 3 illustrates injection of whisky performed using the filler device.

FIG. 3 shows filling valves 20*a* to 20*e* that are located at appropriate positions in the filler device 10, container supporting units 12*a* to 12*e* corresponding to thereto, bottles 13*a* to 13*e* that are respectively mounted on the container supporting units 12*a* to 12*e*, and guide members 40*a* to 40*e* that are attached to the filling valves 20*a* to 20*e*. Note that the suffixes "a" to "e" added to the reference numerals of components are provided only for the purpose of facilitating description, and the configurations of the components are the same.

In FIG. 3, the first one from the left shows a state immediately after the bottle 13*a* has been conveyed from the carry-in conveyer 14 to the container supporting unit 12*a*, for example. At this time, the container supporting unit 12*a* has not been lifted, and therefore the opening portion 18*a* of the bottle 13*a* is not abutted against the abutting member 46*a* of the guide member 40*a*.

In FIG. 3, the second one from the left shows a state after a certain period of time has elapsed from when the lifting of the container supporting unit 12*b* was started, the opening portion 18*b* of the bottle 13*b* is abutted against the abutting member 46*b* of the guide member 40*b*, and lifting of the lower main body 42*b* has started. At this time, the filling of the bottle 13*b* with whisky has not been started.

In FIG. 3, the third one from the left shows a state in which the filling port 26 is open due to the opening portion 18*c* of the bottle 13*c*, which abuts against the abutting member 46*c*, lifting the lower main body 42*c* and the upper main body 41*c* of the guide member 40*c*, and further pressing the press-target portion 25, as a result of the container supporting unit 12*c* being further lifted. At this time, whisky in the filler bowl 11 passes through the respective internal spaces of the housing 21, the outer valve body 22, and the inner valve body 23, and is filled into the bottle 13*c* via the filling port 26.

In FIG. 3, the fourth one from the left shows a state after the bottle 13*d* has been filled with whisky, the press-target portion 25 has been released from the pressure applied by the opening portion 18*d* of the bottle 13*d* as a result of the container supporting unit 12*d* being lowered, and the filling port 26 is closed. Although the opening portion 18*d* of the bottle 13*d* that abuts against the abutting member 46*d* is still lifting up the lower main body 42*d* of the guide member 40*d*, the upper main body 41 has been lowered to the initial suspension position.

In FIG. 3, the fifth one from the left shows a state immediately before the bottle 13*e* is conveyed from the container supporting unit 12*e* to the carry-out conveyer 15, for example. At this time, the container supporting unit 12*e* has been sufficiently lowered, and therefore the opening portion 18*e* of the bottle 13*e* does not abut against the abutting member 46*e* of the guide member 40*e*.

Although the product in the above-described embodiment is whisky, which is a beverage, the product is not limited to whisky. The product may be any product that is to be filled into containers such as bottles, cans, PET bottles, or paper cartons, and examples of the product include alcoholic beverages such as rum, tequila, gin, brandy, and wine, beverages such as water, coffee, and milk, seasonings, cosmetics, and drugs.

Note that each filling valve 20 is configured such that the height position of the press-target portion 25 can be adjusted by chanting the number, the thickness, and so on, of spacers 28 according to the shape of the containers.

The upper outward protruding portion 43*a* that protrudes outward is provided at the upper end of the upper main body 41, i.e., the upper end of the upper case 41*a*.

Figure 7:
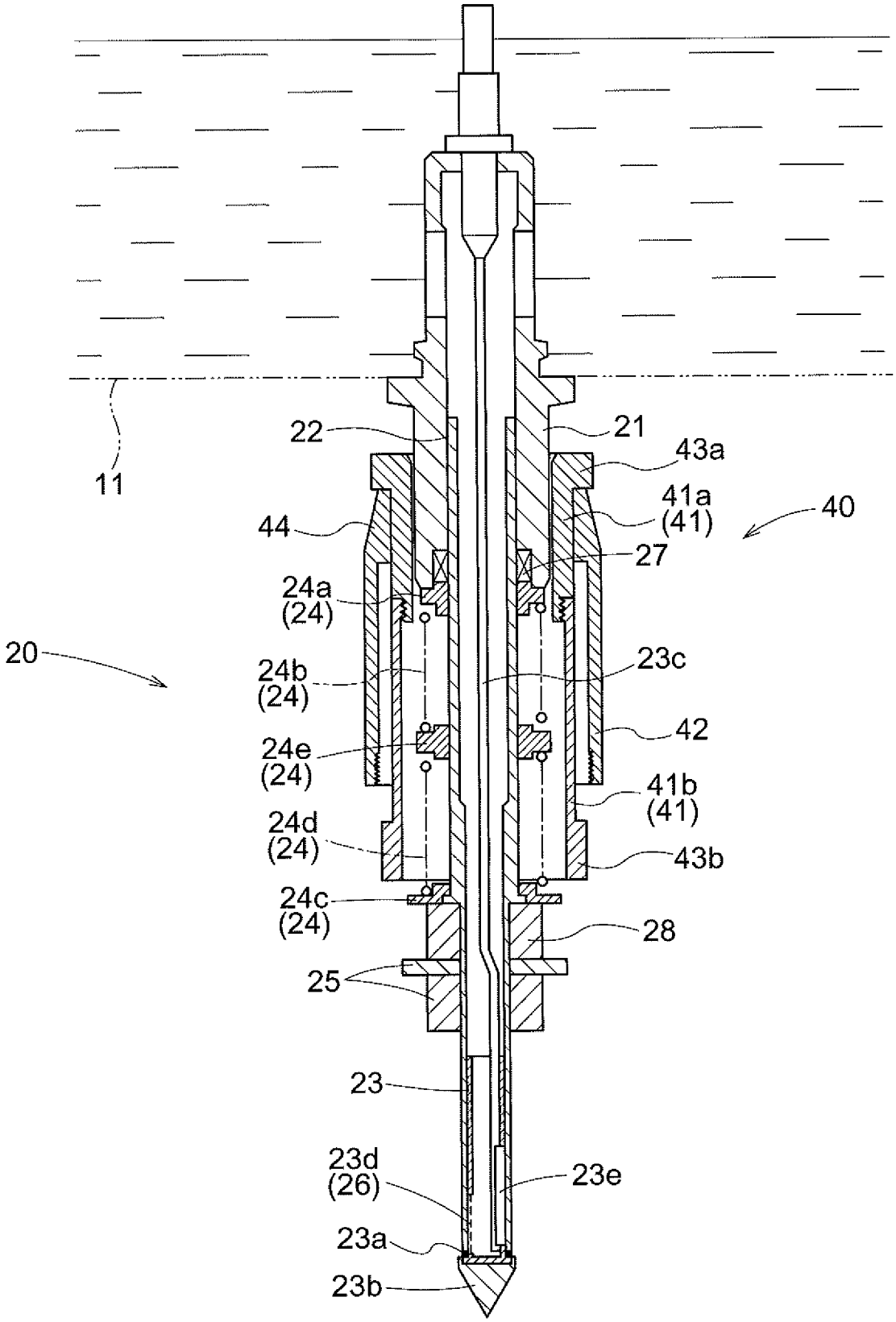
FIG. 7 illustrates details of the guide member according to the present invention.

As shown in FIG. 7, if the abutting member 46 is removed from the lower main body 42 and the lower main body 42 is pushed up, the upper surface of the inward protruding portion 44 of the lower main body 42 and the lower surface of the upper outward protruding portion 43*a* of the upper main body 41 abut against each other, and thus the upper main body 41 is also pushed up.

Also, as shown in FIG. 7, both the lower main body 42 and the upper main body 41 are pushed up until the press-target portion 25 and the spacers 28 are seen. In this state, the number, the thickness, and so on, of the spacers 28 can be easily changed. The height position of the press-target portion 25 can be easily adjusted by making changes to the spacers 28.

Note that the upper main body 41 and the lower main body 42 are configured such that, in a state where the push-up portion 48 of the abutting member 46 and the lower outward protruding portion 43*b* of the upper main body 41 are in contact with each other, the upper surface of the inward protruding portion 44 of the lower main body 42 and the lower surface of the upper outward protruding portion 43*a* of the upper main body 41 do not abut against each other, and even in a state where the abutting member 46 is removed and the upper surface of the inward protruding portion 44 of the lower main body 42 and the lower surface of the upper outward protruding portion 43*a* of the upper main body 41 abut against each other, the lower end of the lower main body 42 covers the lower outward protruding portion 43*b* of the upper main body 41.

If it is unnecessary to change the height position of the press-target portion 25, the filling valves 20 may not be provided with the upper outward protruding portion 43*a*.

The above-described embodiment is an example of the present invention, and is not intended to limit the present invention. The specific configuration of each portion may be subjected to design changes as appropriate, as long as operative effects can be achieved.

DESCRIPTION OF REFERENCE SIGNS

10: Filler Device
11: Filler Bowl
12: Container Supporting Unit
13: Bottle (Container)
18: Opening Portion
20: Filling Valve
21: Housing
22: Outer Valve Body
23: Inner Valve Body
23*a*: Seal
23*b*: Valve Body
23*c*: Pipe Body
23*d*: Opening
23*e*: Opening
24: Biasing Unit
24*a*: Upper Fixing Portion
24*b*: Upper Spring
24*c*: Lower Fixing Portion
24*d*: Lower Spring
24*e*: Coupling Portion
25: Press-target Portion
26: Filling Port
27: Seal
28: Spacer
40: Guide Member
41: Upper Main Body
41*a*: Upper Case
41*b*: Lower Case
42: Lower Main Body
43*a*: Upper Outward Protruding Portion
43*b*: Lower Outward Protruding Portion
44: Inward Protruding Portion
45: Opening Portion
46: Abutting Member
47: Abutting Portion
48: Push-up Portion

What is claimed is:

1. A guide member that is attachable to a filling valve of a filler device for filling a container with a product, the guide member comprising:

an upper main body having an inner surface and an outer surface, the upper main body positioned to permit the filling valve to pass through the inner surface of the upper main body, and be movable in a vertical direction relative to the filling valve; and a lower main body slidably coupled to the upper main body, configured to be slidable on the outer surface of the upper main body, wherein the lower main body is provided with an abutting portion that protrudes inward relative to an inner surface of the lower main body and that is configured to abut against at least an opening portion of the container for filling, the guide member is configured to allow the container to be lifted while keeping the abutting portion abutted against the opening portion, thereby guiding the opening portion to an appropriate position relative to the filling valve, wherein a lower outward protruding portion that protrudes outward is provided at a lower end of the upper main body, an inward protruding portion that protrudes inward is provided at an upper end of the lower main body, the upper main body and the lower main body are configured to be slidable on each other along a common axis such that at least the lower outward protruding portion slides on the inner surface of the lower main body, or the inward protruding portion slides on the outer surface of the upper main body, the lower main body is configured such that the inward protruding portion and the lower outward protruding portion engage each other due to the weight of the lower main body, wherein an upper outward protruding portion that protrudes outward is provided at an upper end of the upper main body, and the upper main body is configured such that the inward protruding portion and the upper outward protruding portion engage each other when the lower main body is pushed up.

2. A filler device for filling a container with a product stored in a filler bowl, the filler device comprising:

a filling valve for filling the container with the product and provided with a filling port configured to be opened and closed;

a container supporting unit configured to be lifted and lowered relative to the filling valve such that the filling port opens when the container supporting unit is lifted and closes when the container supporting unit is lowered; and a guide member comprising:

an upper main body having an inner surface and an outer surface, the upper main body positioned to permit the filling valve to pass through the inner surface of the upper main body, and be movable in a vertical direction relative to the filling valve; and a lower main body slidably coupled to the upper main body, configured to be slidable on the outer surface of the upper main body, wherein the lower main body is provided with an abutting portion that protrudes inward relative to an inner surface of the lower main body and that is configured to abut against at least an opening portion of the container for filling, and the guide member is configured to allow the container to be lifted while keeping the abutting portion abutted against the opening portion, thereby guiding the opening portion to an appropriate position relative to the filling valve, wherein the filling valve further includes:

a housing that is tubular and penetrates through a bottom surface of the filler bowl;

an outer valve body that is tubular and is inserted into the housing;

an inner valve body that is tubular, an upper end thereof being fixed to the housing, and is inserted into the outer valve body, and wherein the filling port is provided in a lower end of the inner valve body; and a biasing unit that biases the outer valve body downward relative to the housing, the outer valve body is provided with a press-target portion that is configured to be pressed upward by an opening portion of the container, the filling valve is configured such that an opening of the container mounted on the container supporting unit presses the press-target portion and moves the outer valve body upward as a result of the container supporting unit being lifted thereby opening the filling port, and the outer valve body is moved downward as a result of the container supporting unit being lowered thereby closing the filling port by a lower end of the outer valve body, the biasing unit includes compression coil springs provided between the housing and the press-target portion, the compression coil springs include an upper spring having an upper end fixed to an upper fixing portion provided at a position closer to the housing than the press-target portion, and a lower spring having a lower end fixed to a lower fixing portion provided at a position closer to the press-target portion than the housing, a lower end of the upper spring and an upper end of the lower spring are coupled to each other by a coupling portion that is provided so as to be slidable on an outer surface of the outer valve body, the upper main body includes an upper case and a lower case that is detachably attached to the upper case, the upper case is located above the lower fixing portion, and is configured to be restricted from moving downward upon a lower end of the upper case coming into contact with the lower fixing portion, and the lower case is configured to extend downward relative to the lower fixing portion, and is configured to allow the press-target portion to slide on an inner surface of the lower case.

3. The filler device according to claim 2, wherein respective outer diameters of the upper fixing portion, the lower fixing portion, and the coupling portion of the filling valve are larger than diameters of the upper spring and the lower spring, an inner diameter of the upper case is larger than the respective outer diameters of the upper fixing portion, the lower fixing portion, and the coupling portion, and the upper case is configured to be slidable at least on the coupling portion, an inner diameter of the lower case is larger than an outer diameter of the press-target portion, and the lower case is configured to be slidable at least on the press-target portion, and a length of the upper case is such that, when the lower end of the upper case covers at least a portion of the lower fixing portion, the upper end of the upper case covers the coupling portion, but does not cover the housing, whereas when the upper end of the upper case covers at least a portion of the housing, the lower end of the upper case covers the coupling portion, but does not cover the lower fixing portion.

* * * * *